United States Patent [19]

Nordstrom

[11] Patent Number: 4,998,603

[45] Date of Patent: Mar. 12, 1991

[54] GARMENT BAG WITH WHEELS AND A DETACHABLE VALET CASE

[75] Inventor: Mark B. Nordstrom, Evergreen, Colo.

[73] Assignee: Samsonite Corporation, Denver, Colo.

[21] Appl. No.: 315,328

[22] Filed: Feb. 23, 1989

[51] Int. Cl.[5] ..... A45C 5/14; A45C 5/12; A45C 13/10

[52] U.S. Cl. ..... 190/18 A; 190/108; 190/110; 190/111; 190/112; 206/287.4; 206/289; 206/292

[58] Field of Search ..... 206/287, 287.1, 289, 206/292, 298, 293; 190/100, 108, 109, 110, 111, 112, 107, 127, 18 A; D3/71, 74; 383/23

[56] References Cited

U.S. PATENT DOCUMENTS

| | | | |
|---|---|---|---|
| Re. 25,826 | 8/1965 | Ward | 190/108 |
| D. 177,591 | 5/1956 | Robinson | D3/74 X |
| D. 267,677 | 1/1983 | Pelavin | D3/71 |
| D. 277,431 | 2/1985 | Bomes et al. | D3/71 X |
| 504,840 | 9/1893 | Krick | 190/108 |
| 1,150,057 | 8/1915 | O'Neil | 190/109 |
| 1,292,493 | 1/1919 | Logan | 190/111 X |
| 1,438,737 | 12/1922 | Witbeck | 206/293 X |
| 1,562,417 | 11/1925 | Schuck | 206/282 |
| 1,760,098 | 5/1930 | Wilt | 206/292 |
| 1,823,403 | 9/1931 | Krueger | 190/124 |
| 1,914,087 | 6/1933 | Gilmore | 190/111 |
| 1,960,455 | 5/1934 | Ritter, Jr. | 206/289 |
| 2,002,638 | 5/1935 | Lee et al. | 206/289 |
| 2,107,180 | 2/1938 | Gihon, 3rd | 190/110 |
| 2,362,807 | 11/1944 | Dresner | 190/110 X |
| 2,453,663 | 11/1948 | Hinson | 190/100 |
| 2,635,721 | 4/1953 | Suben | 190/109 X |
| 2,740,506 | 4/1956 | Davis | 206/287.1 |
| 2,754,945 | 7/1956 | Kish, Jr. | 190/127 |
| 2,774,450 | 12/1956 | Smallberg | 206/287.1 X |
| 2,797,779 | 7/1957 | Davis | 206/287.1 X |
| 2,839,167 | 6/1958 | Thorlough Smith | 206/287.1 X |
| 2,985,266 | 5/1961 | Pelauin | 190/127 |
| 3,104,740 | 9/1963 | Koffler | 190/115 |
| 3,273,678 | 9/1966 | Koret | 190/109 |
| 3,291,266 | 12/1966 | Komroff | 383/23 X |
| 3,437,181 | 4/1969 | Blount, Jr. | 190/111 |
| 3,447,649 | 6/1969 | Kish, Jr. | 190/111 |
| 3,754,773 | 8/1973 | Bruno | 190/12 A X |
| 3,869,034 | 3/1975 | Thornton, Jr. | 190/111 X |
| 3,944,032 | 3/1976 | Samhammer et al. | 206/292 |
| 4,081,061 | 3/1978 | Tucker | 190/108 |
| 4,206,835 | 6/1980 | Shapiro | 190/108 |
| 4,244,453 | 1/1981 | Herz | 206/278 |
| 4,262,780 | 4/1981 | Samuelian | 190/18 A |
| 4,406,353 | 9/1983 | Walker | 206/287.1 X |
| 4,420,068 | 12/1983 | Gerch | 190/102 |
| 4,436,189 | 3/1984 | Baum | 190/108 |
| 4,538,709 | 9/1985 | Williams et al. | 206/287.1 X |
| 4,598,803 | 7/1986 | Ghiassi | 190/108 |
| 4,655,343 | 4/1987 | Lane et al. | 206/287.1 |
| 4,685,560 | 8/1987 | King | 206/287.1 |
| 4,693,368 | 9/1987 | King et al. | 206/287.1 |

FOREIGN PATENT DOCUMENTS

| | | | |
|---|---|---|---|
| 946333 | 4/1974 | Canada | 190/111 |
| 490814 | 8/1955 | Italy | 190/107 |
| 664476 | 3/1988 | Switzerland . | |
| 598519 | 2/1948 | United Kingdom | 206/298 |
| 627282 | 8/1949 | United Kingdom | 190/111 |
| 671440 | 5/1952 | United Kingdom | 190/111 |
| 2184938 | 7/1987 | United Kingdom | 190/100 |

*Primary Examiner*—Sue A. Weaver
*Attorney, Agent, or Firm*—Gary M. Polumbus

[57] ABSTRACT

An article of luggage includes a garment bag portion and a valet case which is selectively removable from the garment bag portion or can be stored within the interior of the garment bag portion. The valet case is deployable to a supported position adjacent to the garment bag portion for convenient use. The garment bag portion, while having a flexible outer main panel, is selectively reinforced along a peripheral wall and is provided with roller support wheel members so that the bag will retain a substantially vertical orientation over the roller support members to allow the article to be rolled across a supporting surface while in a self-supporting folded condition.

4 Claims, 4 Drawing Sheets

94
36
96
28
30
22
32
20
26
64
48
78
72

34
66
104
40a
40b
144a
70
76
126
110
24
138

154a
68
158a
62
60
164
144a
134
38
128
58
158b
42
116
152
144b
126
120
122
124
160
112
118
74

GARMENT BAG WITH WHEELS AND A DETACHABLE VALET CASE

BACKGROUND OF THE INVENTION

1. Field of the Invention

The present invention relates generally to articles of luggage and more particularly to a garment bag that includes a detachable valet case and is mounted on wheels so that the entire article can be easily rolled across a supporting surface.

2. Description of the Prior Art

Garment bags have met with significant acceptance by travelers for many reasons, including their relatively light weight which makes carrying them easier, the ease of which they can be packed with clothes and other items, their flexibility to fit within certain otherwise confining spaces, an ability to carry them into the passenger compartment of commercial passenger aircraft, and others. One of the common disadvantages of garment bags is that it is difficult to confine small items such as shoes and cases for personal toiletry items within the garment bag. Many travelers, as a consequence, leave such smaller items loose in the garment bag or pack them in separate smaller suitcases. However, the necessity to use a separate smaller suitcase makes travelling more difficult because the smaller suitcase must also be carried and accounted for in addition to the garment bag.

Attempts have been made to make garment bags more useful as a single article of luggage. An invention described in U.S. Pat. No. 4,662,513 entitled "Garment Bag With Improved Packing Capability" which is of common ownership with the present application, describes an improved garment bag in which pocket-like enclosures are provided within the bag in which to pack a small number of relatively small items, such as shoes. Wardrobe luggage cases, which were commonly used many years ago, employed internal compartments in which certain small items could be packed and some of these internal compartments were even removeable after the wardrobe was opened. Wardrobes, however, fell into disfavor and remain in disfavor because they are basically very large, heavy, hard to handle and they have substantially rigid outer shells or walls. Wardrobes are usually more inconvenient for use than the present day large sized hard shelled suitcases.

Modern attempts have been made to attach garment bags and garment bag-like enclosures to small cases, such as small suitcases or attache cases. Usually these attempts involve wrapping the garment bag around the sides and bottom of the small case and attaching the ends of the garment bag at the handle of the small case. Other attempts include folding the garment bag-like enclosure in an accordion-like manner and connecting the garment bag enclosure to one side of the small case.

Until recently, the prior attempts at combining garment bags in small cases have all centered primarily around attempts to make the transportation of the two separate luggage articles more convenient. If any actual improvement in convenience has been obtained by such prior arrangements, the improvements in convenience seem somewhat insignificant since such arrangements do not seem to enjoy significant popularity among travelers. It would not appear that such prior attempts at combining garment bags and small cases have resulted in any significant improvements or advancements in making the luggage article more readily useable in a personal toiletry and clothing housing sense, as compared to that level of convenience which two separate luggage articles would themselves achieve.

Recently, however, significant improvements have been made in integrating the convenience in transportation features and the convenience of use features of a combination garment bag and packing case. U.S. Pat. No. 4,693,368 entitled "Combination Garment Bag and Packing Case Luggage Article", which is also of common ownership with the subject application, describes a garment bag including a conveniently deployable packing case which solves many of the previous shortcomings, but even this combination luggage lacks some desirable features available in other types of luggage such as the ability to roll the article of luggage across a supporting surface.

As a means of transportation, the incorporation of wheels into articles of luggage have met with much success and acceptance by the consuming public but it is difficult to incorporate wheels into garment bags due to the fact that the garment bags are made of flexible material which will not readily retain a consistent somewhat vertical orientation over supporting wheels. An attempt at incorporating wheels into a flexible walled piece of luggage is disclosed in U.S. Pat. No. 4,262,780 entitled "Fixture for Converting Luggage for Articulated Movement". As will be appreciated in that disclosure, the wheels are incorporated into end walls of the luggage but the luggage is permitted to articulate relative thereto so that the luggage can actually lean to one side or the other of the walls in which the wheels are mounted. This is felt to be an undesirable arrangement in that the article of luggage would appear to be unstable and easily tipped over which is inconveniencing at the least to the user of the luggage.

It is against this general background that the present invention has evolved.

SUMMARY OF THE INVENTION

The present invention is directed to an article of luggage that may be appropriately categorized as a garment bag with a detachable valet case and includes wheels for easy transportation.

The garment bag portion of the article has a flexible generally rectangular panel so that the article inherently includes the benefits commonly credited to garment bags but in addition has a peripheral wall or rail including a top rail, a bottom rail, and a pair of opposing side rails which provide enough rigidity to the article so that it can be mounted on wheels and dependably pulled or rolled on its wheels without an unusual likelihood of being tipped over. The top and bottom rails of the article include rigid reinforcement framework or bars which extend a short distance up the adjacent side rails to assist in retaining a generally perpendicular relationship between adjacent rails. The rigid reinforcement bars also include means for mounting wheel assemblies so that when the article is folded into a transport condition with the top and bottom rails forming a lower supporting surface for the article, the wheels will be in engagement with the supporting surface to allow the article to be easily rolled across the surface. The side rails also include semi-rigid interfacing at strategic locations as well as reinforcement flaps which are integrated thereinto so that when the article is folded into its closed transport condition, the flaps can form extensions up the associated side rails to assist in retaining the side rails in a vertical orientation relative to the top and bottom rails on which the article is supported.

It will thus be appreciated, that significant features have been incorporated into the peripheral wall to establish enough rigidity to permit dependable use of wheels on the article. This of course is achieved while retaining the flexible nature of the outer panel for the article.

The valet case which is detachably connected to the garment bag portion of the article is connected to the bottom rail in a pivoted fashion so that the valet case can be moved between a stored position within the confines of the garment bag and a deployed position wherein it is conveniently disposed for ready access by a user of the article. The connection of the valet case to the bottom rail of the garment bag is releaseable so that the valet case can be completely separated from the garment bag for use independently thereof.

A unique strap support system is provided for retaining the valet case in either its deployed position relative to the garment bag or its folded position within the garment bag depending upon whether the garment bag is open in its ready to use condition or folded in its transport condition.

Another unique feature of the article of luggage resides in the fact that a system is disclosed for suspending the valet case from the garment bag when the garment bag is open in a manner such that relatively long articles of clothing supported within the garment bag can pass between the garment bag and the valet case for free flowing suspension.

Other aspects, features and details of the present invention can be more completely understood by reference to the following detailed description of a preferred embodiment, taken in conjunction with the drawings, and from the appended claims.

DESCRIPTION OF THE PREFERRED EMBODIMENTS

Figure 1:
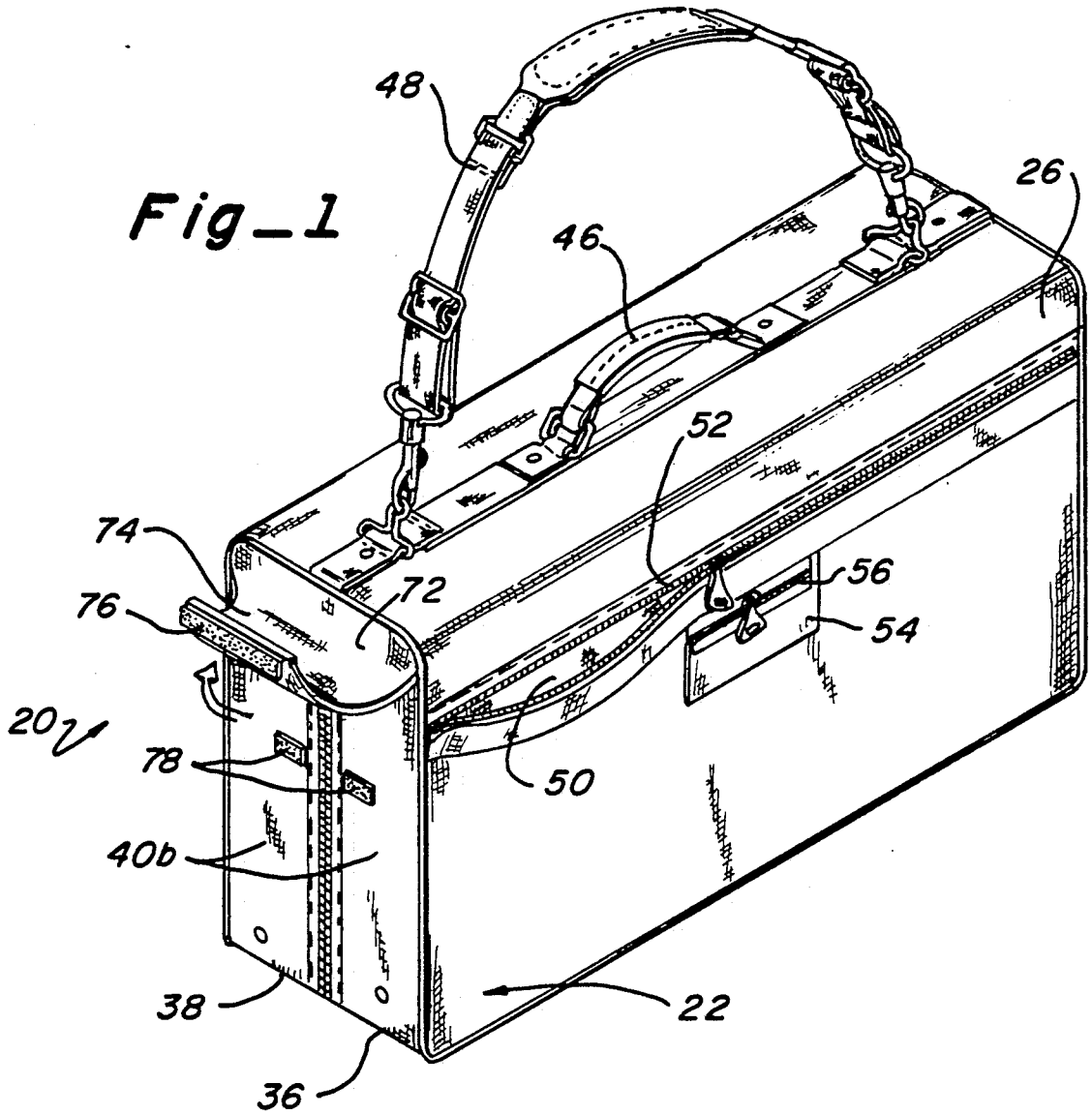
FIG. 1 is a perspective view of the article of luggage of the present invention in a closed transport condition.
Figures 3, 4, 5, 6:
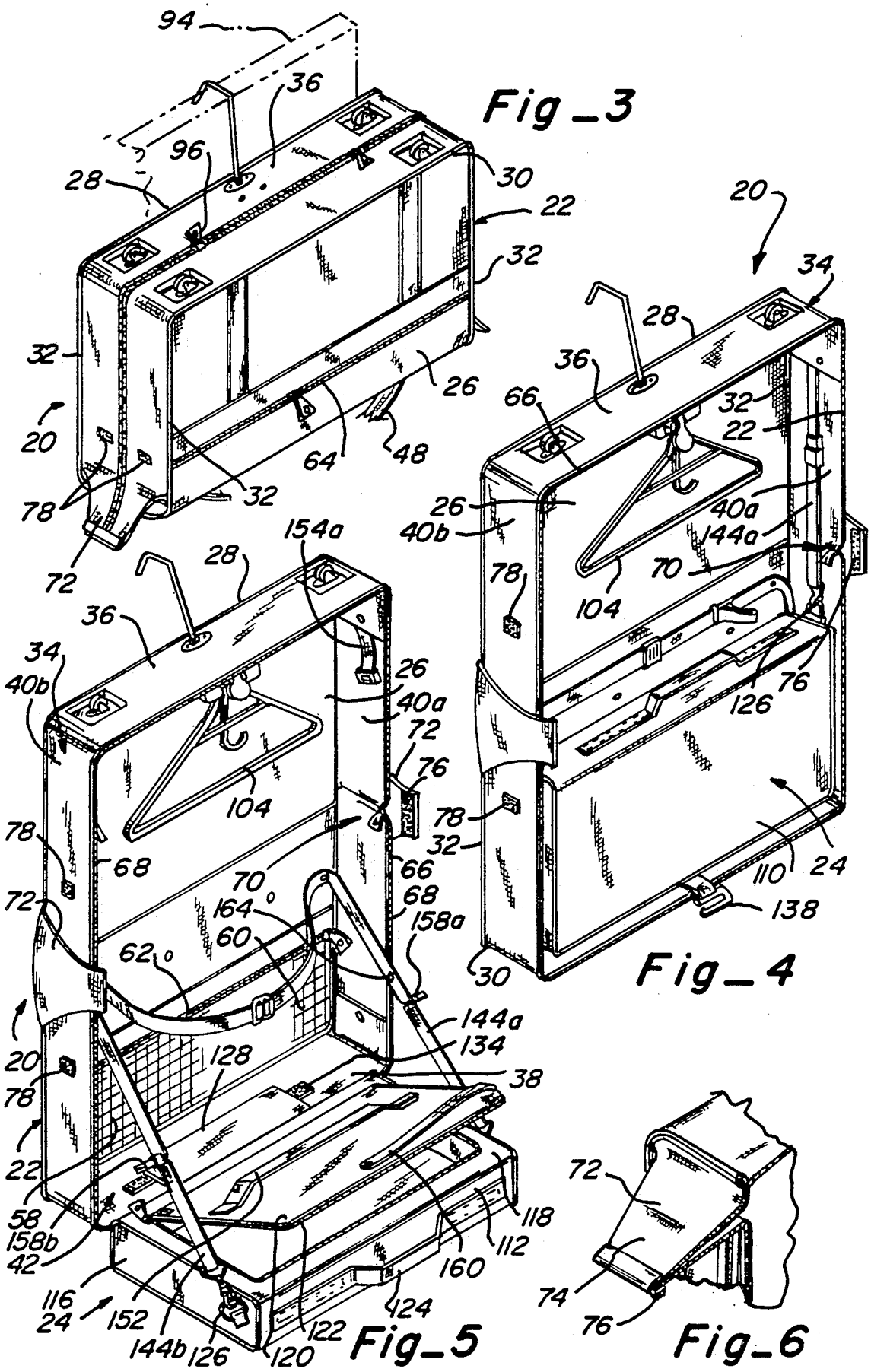
FIG. 3 is a perspective view of the article shown in FIG. 1 showing the article in an inverted orientation and with a dashed line representation of a door on which the article can be supported.
FIG. 4 is a perspective view of the article of luggage of the present invention in an open condition with the valet case disposed within the garment bag portion of the article.
FIG. 5 is a perspective view similar to FIG. 4 with the valet case in a deployed position in the ready-to-use condition.
FIG. 6 is an enlarged fragmentary perspective view of a portion of the article with parts broken away illustrating the side flaps provided at intermediate locations along the side walls of the article.

The article of luggage 20 of the present invention may be referred to as being of the garment bag type with the added advantages of including a detachable valet case and wheel assemblies so that it can be rolled across a supporting surface when in a folded or transport condition. The article 20 is pivotable between a folded, closed transport condition as illustrated in FIG. 1 and an extended, open use condition as illustrated in FIGS. 4 and 5.

The article 20 includes two basic component parts, namely a garment bag portion 22 and a valet case 24. The valet case is detachably connected to the garment bag portion so that the valet case is pivotally moveable between a stored position within the garment bag portion as seen in FIG. 4 and a deployed position as illustrated in FIG. 5.

The garment bag portion 22 of the article, as best seen in FIGS. 3, 4, 5 and 7, basically includes a flexible main panel or body 26 of generally rectangular configuration having a top edge 28, a bottom edge 30 and side edges 32 away from which a peripheral wall or rail 34 extends. The peripheral wall 34 forms a substantially perpendicular forward extension away from the main panel 26 and comprises a top wall or rail 36, a bottom wall or rail 38 and a pair of opposing side walls or rails 40*a* and 40*b* interconnecting the top and bottom walls. A support or suspension system 42 comprised of various strap members is incorporated into the article 20 to support the valet case 24 in selected positions and orientations. The support system will be described in more detail hereinafter.

Figure 7:
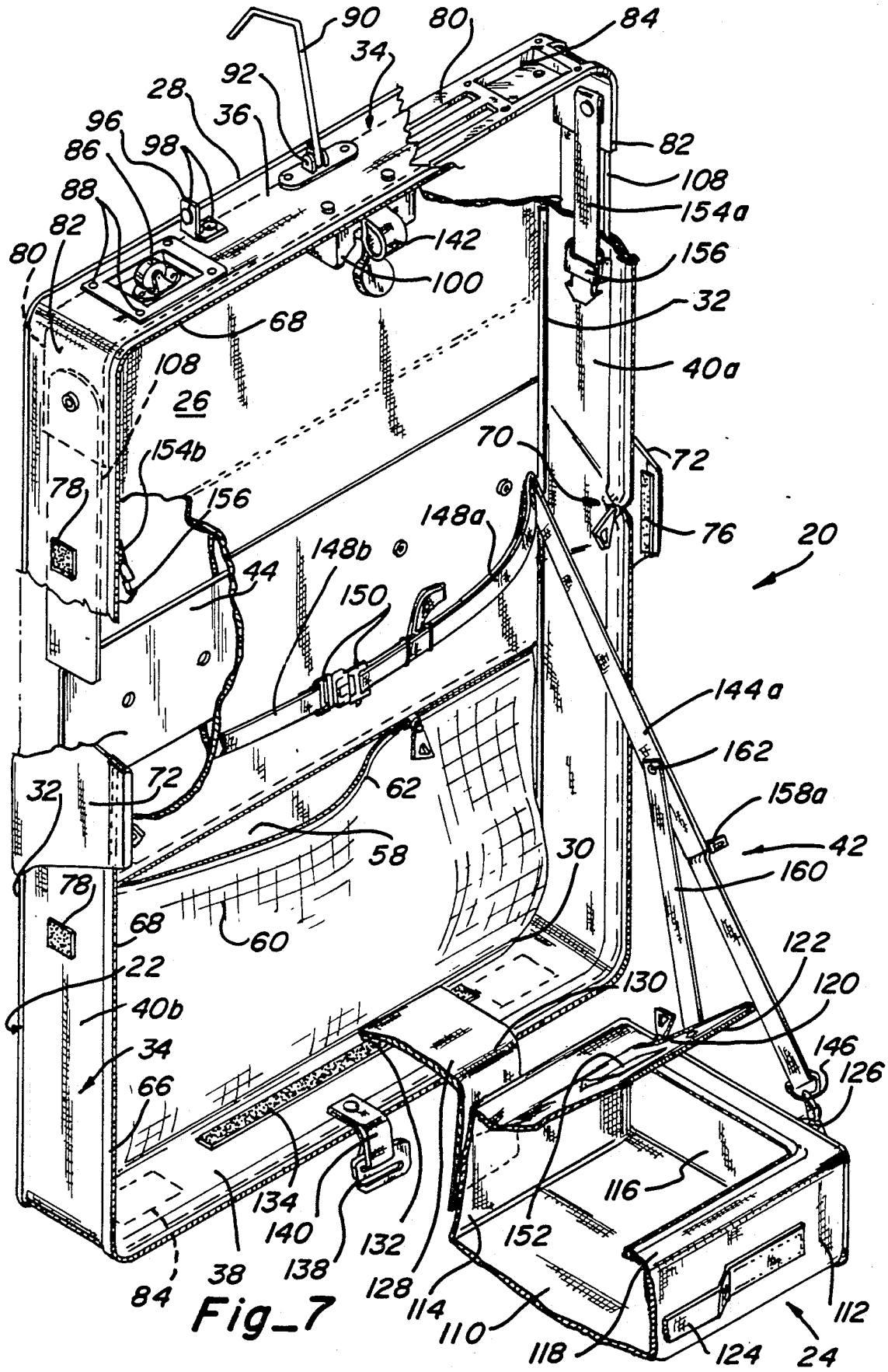
FIG. 7 is an enlarged perspective view similar to FIG. 5 with parts broken away for clarity.

As probably best seen in FIG. 7, the main panel 26 has a transverse rectangularly shaped rigid reinforcement plate 44 secured thereto at its longitudinal center to provide a support base for a carrying handle 46 and an adjustable shoulder strap 48 which are both anchored to the rigid reinforcement plate 44 in any suitable manner. Several pouches are also integrated into the main panel 26 as by incorporating additional layers of material to define the pouches. For example, as seen in FIG. 1, a large pouch 50 covering approximately a third of the main panel 26 is provided adjacent to the top wall 36. The pouch 50 has a zipper closure 52 on the external surface of the main panel extending transversely of the article 20 to open and close the pouch 50. Also disposed in this portion of the main panel 26 on the exterior surface thereof is a smaller identification pouch 54 having a zipper closure 56 so that an identification card or other such article can be maintained therein. On the opposite end of the main panel 26 adjacent to the bottom wall 38, another large pouch 58, best seen in FIGS. 3 and 5, covering approximately a third the size of the main panel is formed by incorporating a mesh or netting type material 60 onto the internal surface of the main panel 26 with a zipper 62 on the interior surface and a zipper 64 on the exterior surface of the panel for gaining access to the pouch 58 formed between the netting 60 and the main panel 26. Of course in the folded condition shown in FIG. 1, the intermediate reinforcing plate 44 of the main panel forms the top of the article of luggage with the large pouches 50 and 58 being disposed on opposite sides thereof.

The outer or free edges of the top, bottom and side walls or rails 36, 38, 40*a* and 40*b* respectively of the garment bag portion of the article define a peripheral edge 66 having secured thereto a continuous closure element 68 which in the preferred form is a zipper. The zipper 68 is disposed on the edge 66 so that it begins and ends at intermediate locations 70, FIGS. 4, 5 and 7, along each side wall 40*a* and 40*b*. The portion of the zipper lying above these intermediate locations 70 passes along the top wall 36 and the upper half of each side wall 40*a* and 40*b* and is connectable to the portion of the zipper 68 lying below these intermediate locations that passes along the bottom wall 38 and the bottom half of each side wall 40*a* and 40*b*. It will therefore be appreciated that the zipper 68 attaches upper and lower segments of the garment bag portion 22 of the article in a continuous manner so as to completely seal the enclosed interior of the garment bag portion from the ambient environment and in a manner such that the upper and lower segments do not move relative to each other. This is an important characteristic of the article in rendering it rigid enough to be rolled on supporting wheels.

At the intermediate locations 70 on each side wall in alignment with the reinforcement plate 44, reinforcing flaps 72 are established in the side walls 40*a* and 40*b* by adding a segment of material 74, FIGS. 4, 5 and 6, having a generally trapezoidal configuration. In actuality, and as best illustrated in FIG. 6, a trapezoidal segment 74 is incorporated into each side wall as a coplanar portion of the side wall so that the thickness of the side wall does not change at the segment 74. The side walls 40*a* and 40*b* and trapezoidal segments 74 are folded as illustrated in FIG. 6 so that the resulting flaps 72 formed thereby can be extended along the side walls 40*a* and 40*b* of the article of luggage when in its closed condition shown in FIG. 1 to establish double layers along the extent of the flaps 72 to reinforce the side walls for purposes of establishing an article that is rigid enough to be transported on wheels. The free ends of the flaps 72 have a fastener-type material 76, such as Velcro, affixed thereto and are adapted to be releasably connected to a pair of mating fasteners 78 provided on the exterior surface of the associated side wall. In this manner, when the article 20 is folded into the closed transport condition of FIG. 1, and the reinforcement flaps 72 are secured to the side walls 40*a* and 40*b* of the article, the article retains a relatively erect composure even though the main panel 26 of the article is made of a flexible material so that the article retains the desired characteristics of a soft-walled garment bag.

Looking next at FIG. 7, it will be appreciated that other reinforcing means are incorporated into the article 20 to provide the article with the desired rigidity for use with wheel assemblies so that the article can be dependably rolled across a supporting surface without tipping over. Looking at the top wall 36 of the garment bag portion 22 in FIG. 7, it will be appreciated that it has been broken away to illustrate a generally U-shaped flat structured board or rigid bar 80 forming a reinforcing framework that extends the full length of the top wall 36 and has curved ends 82 that project a short distance along the adjacent side walls 40*a* and 40*b*. The rigid bar 80 has a width that is greater than half the width of the top wall 36. An identical rigid flat bar 80 (not specifically shown) is provided in the bottom wall 38 of the garment bag portion as well. The rigid bars 80 can be made of any lightweight and reasonably rigid material such as plastic and serve several useful purposes. First of all, it will be appreciated that the bars have rectangularly-shaped openings 84 adjacent opposite ends thereof so that preformed and conventional wheel assemblies 86 can be incorporated into the walls 36 and 38 and held in place by suitable fasteners 88. The wheel assemblies 86 project outwardly away from the associated top or bottom walls so that when the article of luggage is in the folded condition of FIGS. 1 and 2, the wheel assemblies will be directed downwardly onto a supporting surface on which the article could be rolled.

Figure 2:
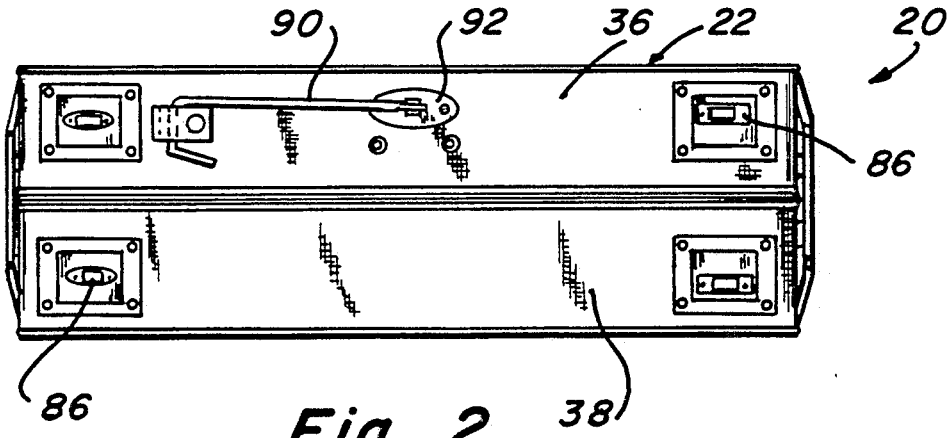
FIG. 2 is a bottom plan view of the article shown in FIG. 1.

A conventional support hook 90 is also affixed to the top wall 36 of the garment bag portion 20 through the use of suitable fasteners that extend through the associated rigid bar 80. The support hook 90 is pivotally mounted on a base 92 so that it can be lifted upwardly into the position illustrated in FIG. 7 for use in supporting the article of luggage on the top of a door 94, a closet rod or the like, or it can be laid in flat engaging relationship with the top wall 36 and releasably retained in this position by a securement flap 96 having a snap type fastener 98, FIG. 7, to hold the hook in place. The flat engaging relationship of the support hook with the article of luggage is illustrated in FIG. 2.

Figure 10:
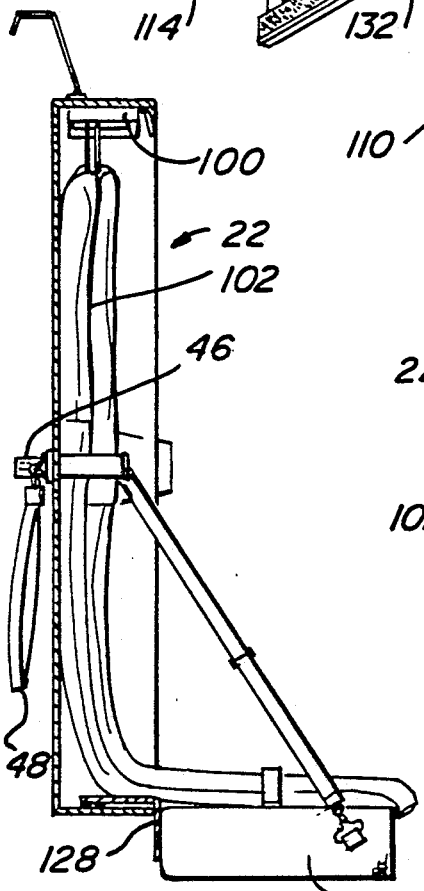
FIG. 10 is a diagrammatic vertical section taken through the article of luggage in the open condition as shown in FIG. 5 with the valet case deployed illustrating the positioning of long garments in the article.

On the inner surface of the top wall 36, a hanger support bar 100 is secured to the top wall through use of fasteners that extend into the associated rigid bar 80 with the support bar serving its customary function of supporting articles of clothing 102, FIG. 10, that are suspended on hangers 104. A variety of different types of support bars are known and could be used in the article. Accordingly, the hanger support bar 100 will not be described in detail herein.

The entire peripheral wall 34 of the garment bag portion 22 has an outer surface of fabric that is identical to that of the main panel 26 and in addition is lined on its inner surface with a fabric so as to establish a double-wall thickness of fabric. Within the confines of the fabric layers on the side walls 40*a* and 40*b*, four strips of innerfacing 108, FIG. 7, of a semi-rigid nature are disposed and retained in a position so as to extend from the curved ends 82 of the rigid bars 80 along an associated side wall toward an intermediate location 70. The innerfacing strips 108, which may just be an additional layer of fabric, terminate short of the reinforcement flaps 72 but serve to retain the side walls in a relationship which is substantially perpendicular to the main panel 26 whether or not the article of luggage is in the open or closed condition.

The valet case 24 which is probably best illustrated in FIGS. 4, 5 and 7, could be of numerous designs but in the disclosed embodiment, the case includes a flexible bottom panel 110 of generally rectangular configuration, a semi-rigid top wall 112, bottom wall 114, and side walls 116, and a top panel 118 also made of a flexible material that has a flap 120 formed therein with a rigid frame (not seen) around its perimeter. The flap 120 is releasably securable in a closed condition by a zipper 122 that extends around three edges of the flap 120 with the fourth edge of the flap which is adjacent to the bottom wall 114 establishing a living hinge so that the flap 120 can be lifted into an open position to allow access to the interior of the valet case. The top wall 112 of the valet case has a handle 124 provided thereon so that the case can be easily transported and a pair of metal rings 126 are hingedly connected to the side walls 116 of the case adjacent to the top wall 112 for connection to the support system 42 of straps to be described later.

Figure 8:
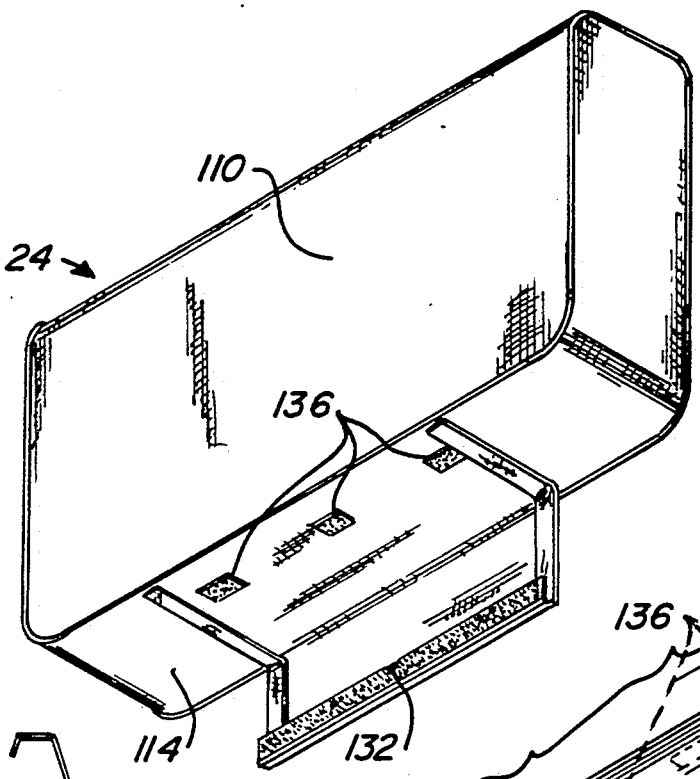
FIG. 8 is a perspective view illustrating the bottom of the valet case with a hinge flap thereof in an extended position.
Figure 9:
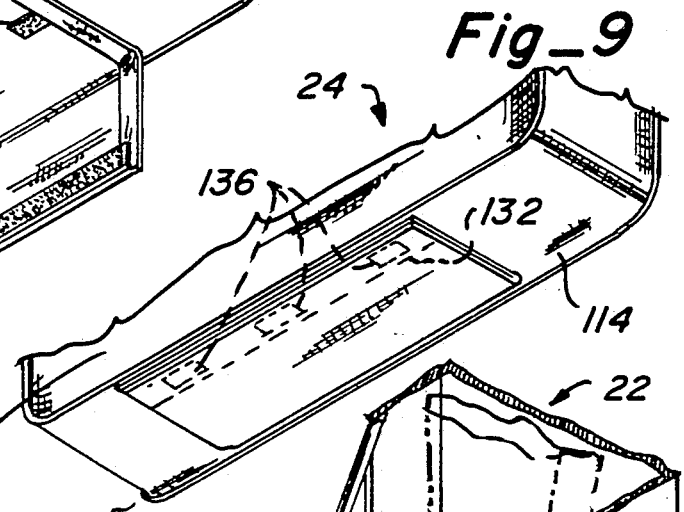
FIG. 9 is a fragmentary perspective view similar to FIG. 8 showing the hinge flap in a folded condition.

The bottom wall 114 of the valet case has a flexible hinge flap 128 secured thereto with the flap being of generally rectangular configuration and being approximately twice the width of the bottom wall 114. The flap 128 may be made of the same fabric as the main panel 26 and is foldable along a fold line 130 so that in a folded condition, it can be positioned closely adjacent to the bottom wall of the valet case but can be extended so as to extend away from the bottom wall and into the garment bag portion 22 of the article. The hinge flap 128 has a strip 132 of Velcro-type fastening material along the underside of its free edge which is adapted to be releasably connected to a complementing strip 134 of Velcro material secured to the bottom wall 38 of the garment bag portion immediately adjacent to the main panel 26. The hinge flap 128 is secured to the garment bag portion in this manner when it is desired to retain the valet case in a connected relationship with the garment bag portion. When it is desired to remove the valet case from the garment bag portion, the hinge flap 128 is released from the Velcro fastener 134 in the garment bag portion and connected to itself through use of Velcro fasteners 136 provided at a separate but aligned location on the portion of the flap 128 which is secured to the bottom of the valet case. This is best illustrated in FIGS. 8 and 9.

It will be appreciated that the provision of the reinforcing rigid bar 80 in the bottom wall 38 of the garment bag portion 22 provides a strong base of support for the valet case 24 when the hinge flap 128 is secured to the garment bag portion. Since the hinge flap is made of a flexible material, it allows the valet case to be moved between a stored position as seen in FIG. 4 and a deployed position as illustrated in FIG. 5. It should also be noted that in the stored position, an S-shaped hook 138, which is attached to a flexible strap 140 secured to the bottom wall 38 of the garment bag portion, is exposed and accessible and can be releasably connected to a looped strap 142 secured to the top wall 36 of the garment bag portion adjacent to the trolley 100. The S-shaped hook 138 is releasably secured to the looped strap 142 when the suitcase is being closed to hold the suitcase in a folded, but only partially closed, condition so that the zipper closure element 68 can be operated more conveniently by use of both of the user's hands, rather than requiring the user to hold the article in the folded condition with one hand while operating the zipper with the other hand. The same is true of opening the garment bag as the zipper 68 can be easily opened with the bag being held in a folded condition by the S-shaped hook cooperating with the looped strap 142.

The previously mentioned support or suspension system 42 for holding the valet case 24 in either one of its positions includes a first set of nonextensible but flexible straps **144*a* and 144*b*, FIGS. 5 and 7, that are anchored to the intermediate reinforcing plate 44 in the garment bag portion adjacent each end thereof next to the side walls 40*a* and 40*b* respectively. Each of these first pair of straps includes a pivotally-mounted, releasable clasp 146 on its free or distal end that is adapted to be releasably connected to the metal rings 126 provided on the side walls of the valet case. When the straps 144*a* and 144*b* are so connected to the valet case, and the valet case is supported on the bottom wall 38 of the garment bag portion by the hinge flap 128, the valet case can be deployed in a generally horizontal spacial orientation perpendicular to the garment bag portion when the garment bag portion is suspended vertically by the support hook 90. This arrangement is illustrated in FIGS. 5 and 7**.

Each one of the first pair of straps has an inward extension portion **148*a* and 148*b* that is also anchored at the end of the rigid reinforcement plate 44 with the extension portions having mating clasps 150 on their free ends so that they can be selectively interconnected to hold garments suspended in the garment bag portion adjacent to the interior surface of the main panel. The extension portion 148*a* is adjustable in length in a conventional manner so as to accommodate various thicknesses of clothing articles suspended in the garment bag portion. It should be pointed out also that the flap 120 on the top panel 118 of the valet case 24 has a garment-retaining strap 152 affixed to its top surface so that extra long garments can be extended under this strap, as seen in FIG. 10**, to confine the lower ends of such garments and prevent the garments from wrinkling when the article of luggage is closed. As will be appreciated, when the article of luggage is closed, the valet case is pivoted into its stored position thereby lifting and supporting the lower ends of such garments in an inverted orientation to prevent them from crumpling or piling up in the bottom of the garment bag portion.

Another pair of short support straps **154*a* and 154*b* are suspended from the curved ends of the reinforcing bar 80 in the top wall 36 of the garment bag portion 22 and these straps also have a fastener 156 secured to their free ends. The fasteners 156 are adapted to be releasably attached to a mating fastener 158*a* or 158*b* secured to each strap 144*a* and 144*b* respectively of the first pair of straps at approximately their longitudinal center. When this connection is made, the valet case is properly retained in the garment bag portion in its stored position as seen in FIG. 4. It will, therefore, be appreciated that the first pair of straps 144*a* and 144*b* serve to support the valet case in either the deployed position of FIGS. 5 and 7 or the stored position of FIG. 4, depending upon whether or not the short straps 154*a* and 154*b* are connected to the fasteners 158*a* and 158*b*** respectively at the longitudinal centers of the first pair of straps.

The last strap that forms a part of the support system 42 is a flexible strap 160 that is anchored at one end to a side edge of the flap 120 formed in the top panel 118 of the valet case 24 and has a releasable fastener 162 on its free end which is adapted to be releasably connected to a mating fastener 164, FIG. 5, provided near the longitudinal center of the associated strap **144*a* of the first pair. When this connection is made, the strap 160 serves to support the flap 120 in the top panel 118 of the valet case in an open condition for ready access to the interior of the valet case. Of course, when the flap 120 in the top panel of the valet case is to be secured in its closed position, this connection is released to allow the flap to be lowered into a coplaner relationship with the top panel 118** of the valet case.

Figure 12:
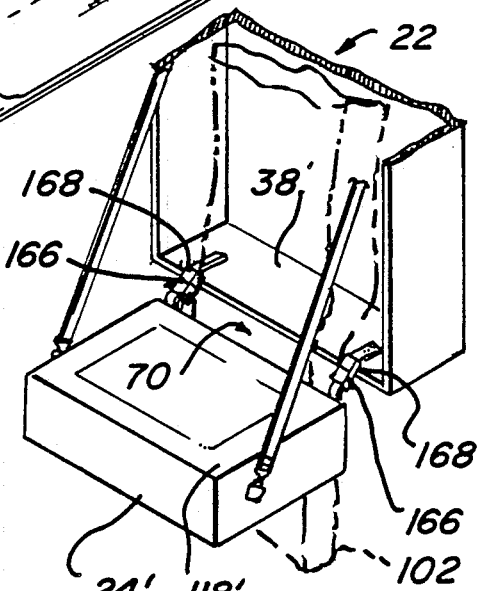
FIG. 12 is a front view of the embodiment illustrated in FIG. 11 again illustrating the alternate embodiment for releaseably connecting the valet case to the garment bag portion of the article.
Figure 11:
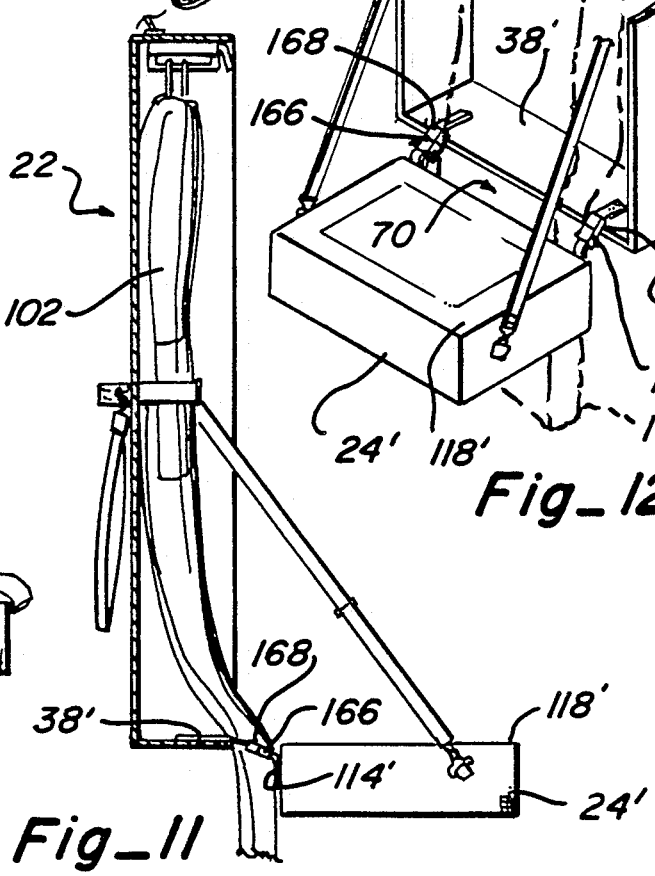
FIG. 11 is a diagramatic side view similar to the position of the article shown in FIG. 10 illustrating a second embodiment of means for connecting the valet case to the garment bag portion of the article.

An alternative embodiment of the present invention is illustrated in FIGS. 11 and 12, wherein like parts have been given like reference numerals with a prime suffix. The valet case 24' has a pair of spaced connectors 166 secured to the bottom wall 114' thereof adjacent to the top panel 118' of the valet case. A complementary pair of spaced connectors 168 are secured to the bottom wall 38' of the garment bag portion 22' adjacent to the outer edge thereof. The connectors 166 and 168 are releasably connectible to pivotally attach the valet case to the garment bag portion in a manner such that a gap 170 exists between the garment bag portion and the valet case when the valet case is in its deployed position so that long garments suspended in the garment bag can hang through the gap in a free flowing condition, as seen in FIGS. 11 and 12, to prevent the garments from remaining in a folded or partially folded condition when the article itself is unfolded. This arrangement also allows access to the interior of the valet case which might otherwise be covered by such long garments. As will be appreciated, in this embodiment of the invention the hinge flap 128 and associated Velco fasteners of the first described embodiment are not necessary. The remaining features of the article are generally similar.

It will be appreciated that an article of luggage has been described which has the advantages of a flexible-walled garment bag so that it can occupy odd-sized spaces but which has been reinforced at strategic locations to provide a semi-rigid wall structure that in the folded condition of the article will hold the garment bag portion in a generally vertical orientation over wheeled support members. It should also be mentioned that since the walls of the valet case are also semi-rigid, the valet case further helps in holding the article in a vertical orientation when the valet case is retained in the garment bag portion. This gives the article of luggage a distinct advantage over prior art garment bags which have been too flexible in nature to be self-supporting in an upright folded position directly over wheel supports. Additionally, in the article of luggage of the present invention the valet case is selectively removable from the garment bag portion in a quick and easy manner so that it can be carried separately when desired. This arrangement, of course, is very convenient when it is desirable to take articles that might be carried in the valet case to a location different from where the garment bag portion remains and is also useful when the garment bag is so full of clothing articles that are suspended by hangers that there is no room for the valet case in which instance the valet case can be carried separately from the garment bag portion.

Although the present invention has been described with a certain degree of particularly, it is understood that the present disclosure has been made by way of example, and changes in detail or structure may be made without departing from the spirit of the invention, as defined in the appended claims.

I claim:

1. An article of luggage comprising in combination:

a garment bag including a flexible elongated main panel which is foldable along a line transverse to its length between an open condition and a folded transport condition, a pair of side walls, a top wall and a bottom wall connected to said panel, said side walls, top wall and bottom walls having continuous free edges displaced from said main panel and fastener means extending along said free edges to releasably secure the free edge of the top wall to the free edge of the bottom wall and a lower half of each side wall free edge to an upper half of the associated side wall free edge when the main panel is in the folded condition to define an enclosed space, a valet case and means for releasably attaching the valet case to the bottom wall of said garment bag in a manner such that it is positionable within said enclosed space when the garment bag is in the folded condition, said means for releasably attaching the valet case includes an extendable flap on the valet case for pivotally connecting the valet case to the garment bag whereby the valet case is pivotal from the bottom wall relative to the garment bag between a stored position and a deployed position, and wherein the valet case extends below the bottom wall when the garment bag is in the open condition and is removed from the confines of said main panel, side walls, top wall, and bottom wall of the garment bag when in the deployed position, and wheel means operatively secured to the garment bag to allow the garment bag to be rolled along a supporting surface when in the folded condition.

2. The article of claim 1 wherein said means for releasably attaching the bottom wall and the flap is Velcro.

3. The article of claim 1 wherein said flap forms a substantially coplanar extension away from said bottom wall when the valet case is in the deployed position.

4. An article of luggage comprising in combination:

a garment bag including a flexible elongated main panel which is foldable along a line transverse to its length between an open condition and a folded transport condition, a pair of side walls, a top wall, and a bottom wall connected to said panel, said side walls, top wall, and bottom walls having continuous free edges displaced from said main panel and fastener means extending along said free edges to releasably secure the free edge of the top wall to the free edge of the bottom wall and a lower half of each side wall free edge to an upper half of the associated side wall free edge when the main panel is in the folded condition to define an enclosed space, a valet case and means for releasably attaching the valet case to the bottom wall of said garment bag in a manner such that it is positionable within said enclosed space when the garment bag is in the folded condition, said valet case having a top panel, a bottom panel, a top wall interconnecting the top and bottom panels, a bottom wall interconnecting the top and bottom panels, and a pair of opposed side walls interconnecting the top and bottom panels, said top wall, bottom wall, and side walls being of semi-rigid construction, and wheel means operatively secured to the garment bag to allow the garment bag to be rolled along a supporting surface when in the folded condition.

* * * * *